US010101006B2

(12) United States Patent
Wang et al.

(10) Patent No.: US 10,101,006 B2
(45) Date of Patent: Oct. 16, 2018

(54) WEARABLE MINING LAMP WITH UNIFORM AUXILIARY LIGHTS

(71) Applicant: Wuhan Kinyun Science & Technology Development Co. Ltd., Wuhan, Hubei (CN)

(72) Inventors: Honghua Wang, Hubei (CN); Chunhua Wang, Hubei (CN); Liangke Yu, Hubei (CN); Chengbo Wan, Hubei (CN)

(73) Assignee: Wuhan Kinyun Science & Technology Development Co. Ltd., Wuhan, Hubei (CN)

( * ) Notice: Subject to any disclaimer, the term of this patent is extended or adjusted under 35 U.S.C. 154(b) by 0 days.

(21) Appl. No.: 15/448,279

(22) Filed: Mar. 2, 2017

(65) Prior Publication Data

US 2017/0205046 A1 Jul. 20, 2017

Related U.S. Application Data

(63) Continuation-in-part of application No. PCT/CN2016/078314, filed on Apr. 1, 2016.

(30) Foreign Application Priority Data

Jan. 15, 2016 (CN) ..... 2016 1 0029323

(51) Int. Cl.
*F21V 21/084* (2006.01)
*F21V 7/00* (2006.01)
(Continued)

(52) U.S. Cl.
CPC ..... *F21V 7/0075* (2013.01); *F21L 4/08* (2013.01); *F21V 7/04* (2013.01); *F21V 23/0414* (2013.01);
(Continued)

(58) Field of Classification Search
CPC ..... A41D 13/01; A42B 3/044; A42B 3/0446; A42B 3/0453; F21L 4/08; F21V 7/0075;
(Continued)

(56) References Cited

U.S. PATENT DOCUMENTS 8,186,021 B2 5/2012 Gonzalez
2008/0205036 A1* 8/2008 Tarter ..... F21L 4/04 362/105
2011/0050123 A1* 3/2011 Duerr ..... F21V 21/084 315/294

FOREIGN PATENT DOCUMENTS

CN 201093202 Y 7/2008
CN 101956956 A 1/2011
(Continued)

*Primary Examiner* — Jason M Han
(74) *Attorney, Agent, or Firm* — Novick, Kim, & Lee, PLLC; Allen Xue

(57) ABSTRACT

The present invention relates to a wearable mining lamp with uniform auxiliary lights, comprising a main light source and a main lamp cup. The mining lamp further comprises auxiliary light sources and auxiliary lamp cups for mounting the auxiliary light sources; the side wall of the auxiliary lamp cup has a reflecting effect, the reflecting surfaces are flat surfaces, and the side wall is in the form of a rearward tapering horn. The miniature lamp cup structure disclosed by the present invention can regulate the low-beam projection in a predefined area to provide uniform illumination without light spots and shadow interferences, so as to provide a high-quality illumination environment for low-beam operation and meet the requirements of close-range observation or operation.

18 Claims, 6 Drawing Sheets

(51) Int. Cl.

| | |
|---|---|
| ***F21L 4/08*** | (2006.01) |
| ***F21V 7/04*** | (2006.01) |
| ***F21V 23/04*** | (2006.01) |
| ***F21V 31/00*** | (2006.01) |
| *F21Y 115/10* | (2016.01) |

(52) U.S. Cl.
CPC ..... *F21V 31/005* (2013.01); *F21Y 2115/10* (2016.08)

(58) Field of Classification Search
CPC ..... F21V 7/0083; F21V 7/04–7/048; F21V 7/06–7/09; F21V 23/0414; F21V 31/005; F21V 33/0008
USPC ..... 362/105–106
See application file for complete search history.

(56) References Cited

FOREIGN PATENT DOCUMENTS

| | | | |
|---|---|---|---|
| CN | 201897085 | U | 7/2011 |
| CN | 202484620 | U | 10/2012 |
| CN | 204083847 | U | 1/2015 |
| CN | 204943076 | U | 1/2016 |

* cited by examiner

WEARABLE MINING LAMP WITH UNIFORM AUXILIARY LIGHTS

FIELD OF THE INVENTION

The present invention relates to an illumination technology or a mining lamp, in particular a wearable mining lamp with uniform auxiliary lights.

BACKGROUND OF THE INVENTION

Wearable mining lamps mainly provide high-beam condensing illumination, but in the operation with the use of wearable mining lamps, the utilization probability of low beams is over 80%. Since the existing mining lamps are not assisted with suitable low-beam lamps, high-beam lamps are usually used as low-beam lamps for illumination. However, due to the small lighting area and the presence of shadow interference, the illumination is not uniform. As a result, the overall illumination effect during the operation is unsatisfied. Light spots with high illuminance of focused high-beam will cause glaring effect and discomfort in the eyes of user, which negatively influences work efficiency. The improvement in the fining degree of maintenance or operation of equipments put forward higher requirements on close-range illumination. A large lighting area and high illuminance are required, and the lighting area is required to have uniform illuminance, to be free of light spots and shadow interferences, so as to provide a favorable illumination environment for low-beam operation to meet the requirements of close-range observation or operation.

Although some of the existing wearable mining lamps can provide low-beam illumination, yet the low-beam light sources having no lamp cup are just used in case of emergency where the main light source is damaged or at break, they cannot be used for illumination for close-range operation because the light beams are weak and scattered. Although some of the existing wearable mining lamps are equipped with low-beam light sources having lamp cups, yet the lights projected by the reflecting surfaces of the lamp cups of the low-beam light sources are not uniform. In addition, due to the limited space within a wearable mining lamp, it is difficult to design a low-beam light source of a wearable mining lamp in the same way as a low-beam light source of a large-sized, immobile illumination device. Since mining lamps are usually used for underground operations, the requirement on the safety of the lamps is very high. It is required that all electronic elements are sealed inside the housing of the mining lamp, which further increases the difficulty of designing the low-beam illumination of a wearable mining lamp.

Therefore, the low-beam illumination of wearable mining lamps so far has not met the requirements of a large illumination area which has uniform and high brightness and is free of light spots and shadow interferences.

The most common way to wear an explosion-proof mining lamp is to wear it at the front of a safety helmet. According to the needs, it can be worn at any location where it can be conveniently fixed, such as on a shoulder strap or on an arm band. Due to the manufacturing technique and the battery volume, traditional mining lamps have a too large thickness. The joint between the insert and the safety helmet acts as a fulcrum, the gravitational moment generated by the center of gravity of the mining lamp is so large that it causes a feeling that the safety helmet on the head is falling forwards. It is inconvenient for a man wearing it to make any motion and it is laborious for a man to wear it for a long time.

In addition, in order to synchronize the optical axis of the high-beam of the mining lamp with the horizontal sight of a user, in some of the existing wearable mining lamps, the entire lamp cup of the high-beam light source is arranged inside the lamp with forward and downward inclination; in some of the existing wearable mining lamps, the angle of fulcrum at the joint between the insert and the safety helmet is adjusted, in order to increase the angle of forward inclination of a mining lamp worn on a safety helmet; in some of the existing wearable mining lamps, the rear wall is configured to be inclined, so that the mining lamp presents a state of inclining forwards and downwards when it is worn on a safety helmet. Such designs, however, further increase the feeling that the safety helmet is falling forwards when a mining lamp is worn on it.

CONTENTS OF THE INVENTION

The present invention is adapted to solve the above-mentioned problem by providing a wearable mining lamp with uniform auxiliary lights for providing close-range illumination, which has a high illuminance and is free of light spots and shadow interferences, in a predefined lighting area. Furthermore, it makes possible that the lighting area of close-range is synchronous with the natural view position of a man wearing it, which improves the amenity of illumination. In addition, improved manufacturing and arranging techniques make it convenient to use the mining lamp and reduce the feeling caused by the mining lamp that the safety helmet is falling forwards.

The present invention relates to a wearable mining lamp with uniform auxiliary lights, comprising a main light source (8), a main lamp cup (7), and it further comprises auxiliary light sources (19) and auxiliary lamp cups (18) for mounting the auxiliary light sources (19), wherein the side wall of the auxiliary lamp cup (18) has a reflecting effect, the reflecting surfaces are flat surfaces, and the side wall is in the form of a rearward tapering horn.

It is preferable that the auxiliary lamp cup (18) is enclosed by a plurality of flat reflecting surfaces arranged one after another, so that the lighting area has uniform illuminance and is free of spot-like shadow. It is further preferable that said plurality of flat reflecting surfaces are 4 to 10 flat reflecting surfaces.

It is preferable that one auxiliary light source and one auxiliary lamp cup are provided on both the left side and the right side of the main lamp cup.

The angle between the front end face of the auxiliary lamp cup and the optical axis of the auxiliary light source is 87° to 91°.

The angle between the optical axis of the auxiliary light source and the upper reflecting surface of the auxiliary lamp cup is 20° to 50°, preferably 20° to 35°, and more preferably 20° to 25°.

The angle between the optical axis of the auxiliary light source and the lower reflecting surface of the auxiliary lamp cup is 35° to 60°, preferably 50° to 60°.

The angles of the optical axis of the auxiliary light source respectively to the left reflecting surface and to the right reflecting surface of the auxiliary lamp cup are between 13° and 20°.

The auxiliary light sources are LED light sources.

The angle between the front end face of the main lamp cup and the optical axis of the main lamp cup is 65° to 69°.

Preferably, in the mining lamp with uniform auxiliary lights, both the main light source and the auxiliary light sources are LED light sources, and an auxiliary lamp cup with an auxiliary light source arranged on the center of its bottom is provided on both sides of the main lamp cup, wherein the main lamp cup and the auxiliary lamp cups are formed integrally.

The side wall of the auxiliary lamp cup is in the form of a rearward tapering horn enclosed by 4 to 10 flat reflecting surfaces arranged one after another, so that the lighting area has uniform illuminance and is free of spot-like shadow.

The angle between the front end face of the main lamp cup and the optical axis of the main lamp cup is 65° to 69°, and the angle between the front end face of the auxiliary lamp cup and the optical axis of the auxiliary lamp light source is 87° to 91°.

Preferably, two auxiliary lamp cups are arranged on both the left and the right sides of the main lamp cup, and the side wall of the auxiliary lamp cups is enclosed by 4, 6 or 8 flat reflecting surfaces, including an upper reflecting surface, a lower reflecting surface, a left reflecting surface and a right reflecting surface, wherein the angle between the upper reflecting surface and the optical axis of the auxiliary light source is 20° to 50°, preferably 20° to 35°, and more preferably 20° to 25°; the angle between the lower reflecting surface and the optical axis of the auxiliary light source is 35° to 60°, preferably 50° to 60°; the distance between the front and the rear end faces of the auxiliary lamp cup is 6 to 15 mm. Preferably, the angles of the optical axis of the auxiliary light source respectively to the left reflecting surface and to the right reflecting surface of the auxiliary lamp cup are between 13° and 20°.

In an embodiment, the distance between the front and the rear end faces of the auxiliary lamp cup is 8 mm, the angle between the upper reflecting surface and the optical axis of the auxiliary light source is 25°, the angle between the lower reflecting surface and the optical axis of the auxiliary light source is 50°, and the angles of the optical axis of the auxiliary light source respectively to the left reflecting surface and to the right reflecting surface of the auxiliary lamp cup are between 13° and 20°.

Preferably, in order to ensure that the charge indicator does not affect the tightness of the mining lamp, a charge indicator hole is arranged at the bottom of the main lamp cup which is integrally formed with the auxiliary lamp cups, a circuit board is fixed on the back of the lamp cup and lies tightly appressed thereto, wherein the main light source, the auxiliary light sources and the charge indicators arranged in the corresponding charge indicator holes are fixed on the circuit board.

Preferably, a housing, a transparent lens, a switch button and a battery are also provided, wherein said housing is formed of a bottom cover and a cylindrical front cover that are fixed as a whole in an air-tight manner by means of a sealing ring, the front cover is fixed with the transparent lens at the front end of the mining lamp as a whole in an air-tight manner, the battery is transversely fixed at a location inside housing that is under the lamp cup and in close proximity to the bottom cover, and the switch button is fixed to the housing in an air-tight manner and is arranged at a location on the top of the bottom cover that is in close proximity to the rear end of the housing.

The present invention discloses a miniature lamp cup structure of a safe mining lamp, which can regulate the low-beam in a predefined area to provide uniform illumination without light spots, so as to provide a high-quality illumination environment for low-beam operation.

The present invention reveals a conclusion that has been improved and proved by the applicant by making a large quantity of experiments. In a light source without any convex lens, it is possible to precisely control the size, direction and brightness of the lighting area only by adjusting the angle of the reflecting surfaces, which are a plurality of flat reflecting surfaces having no curvature, and it is possible to eliminate significant fluctuations of illuminance in the lighting area, so as to present a light curtain effect having uniform brightness, thereby providing a high-quality illumination environment for low-beam operation, such as for close-range maintaining operation of devices or for reading. The arrangement of a pair of auxiliary lamp cups helps to strengthen such effect. A common low-power LED light source is used to project an area of about 1 square meter having uniform illuminance of not less than 15 lux on the lighting area lying 1 meter ahead of the mining lamp.

In the present invention, it is preferable to use LED light sources, which, compared to bulbs serving as light sources, further minimize the distance between the front and the rear end faces of the lamp cup and the volume of the lamp cup, in order to realize the effect of providing sufficient illuminance while meeting the requirement on the size of the lighting area. Of course, it is not excluded that bulbs can be used as light sources in the present invention.

In accordance with the using habits, under the comprehensive consideration of minimizing the volume of the mining lamp and saving energy, the area of the lower reflecting surface of the auxiliary lamp cup is enlarged, and the angle to the optical axis is increased, so that when the mining lamp is worn on the head, the low-beam lighting area is appropriately displaced downwards, so as to increase the brightness.

The charge indicator is arranged at the bottom of the lamp cup, which can simplify the installation process, guarantee the tightness and safety of the lamp body, and make the use convenient.

Battery which has larger proportion by weight, and switch button, are arranged as rearward as possible, so as to reduce the moment of the forward falling force. The switch button is arranged on the top and extends rearwards, by utilizing the space spared by the rearward curvature of the safety helmet, to reduce the thickness of the lamp body and the moment of the forward falling force as much as possible, without affecting the convenience of use.

THE DRAWINGS SHOW

1—front cover, 2—bottom cover, 3—switch button, 4—button ring, 5—lamp switch, 6—transparent lens, 7—main lamp cup, 8—main light source, 9—circuit board, 10—battery, 11—screw gasket, 12—seal ring, 14—insert, 15—screw, 17—waterproof ring, 18—auxiliary lamp cup, 19—auxiliary light source, 20—charge indicator hole, 21—optical axis of main beam, 22—optical axis of auxiliary light source, 23—upper reflecting surface, 25—incident light group, 26—reflected light group, 27—area illuminated with uniform auxiliary lights, 28—optical axis of sight, 29—synchronous angle of inclination, 30—lamp thickness.

DETAILED DESCRIPTION OF THE INVENTION

Figure 1:
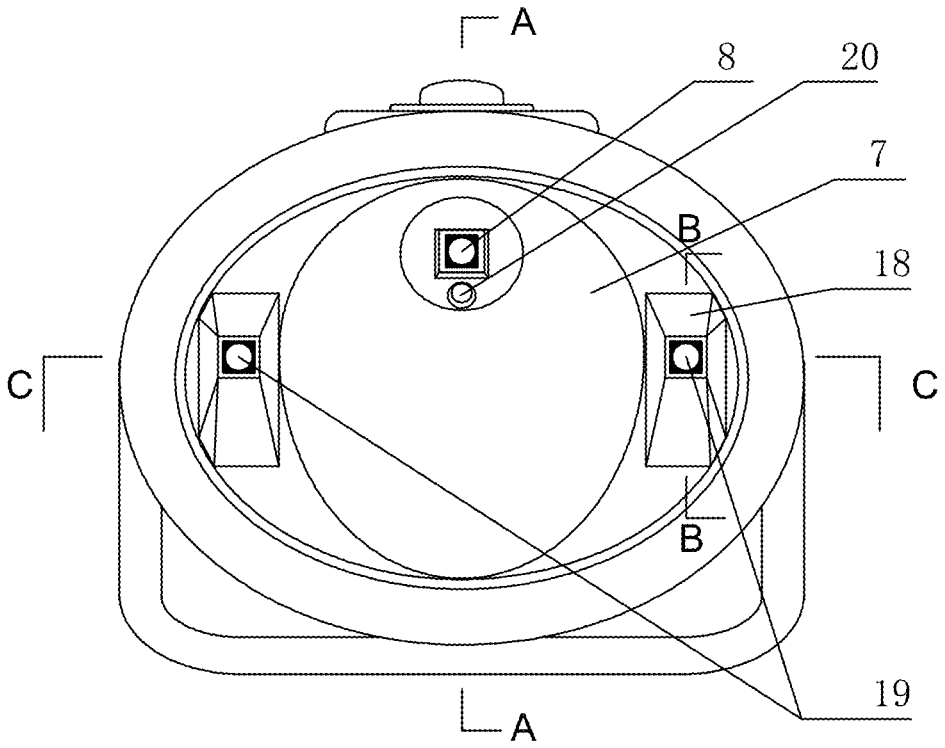
FIG. 1 is a front view of the structure according to a preferred embodiment of the present invention.
Figure 2:
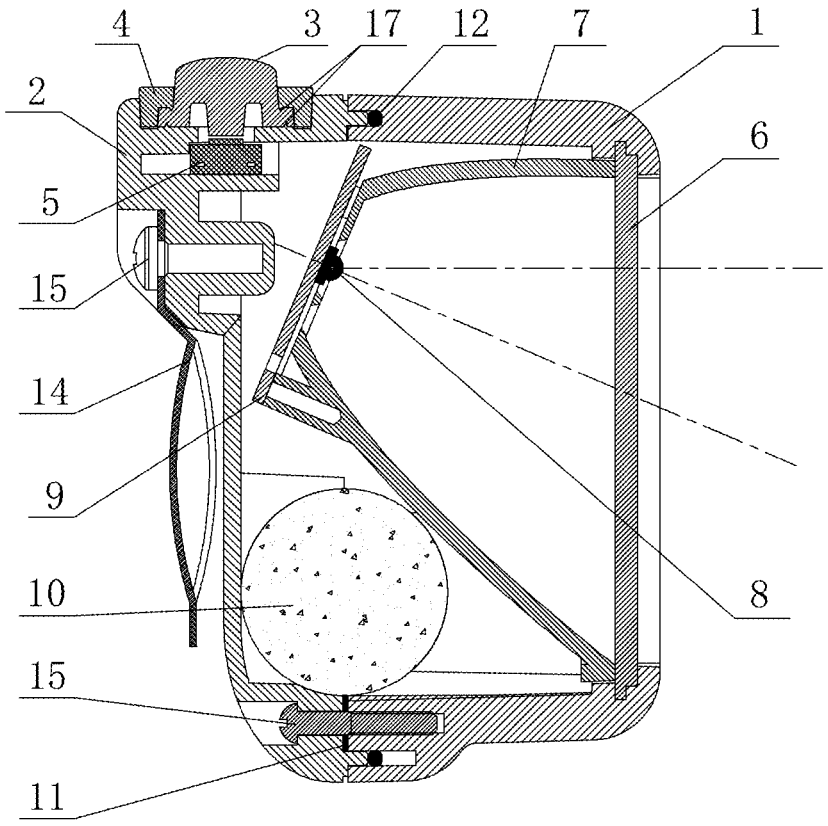
FIG. 2 is a schematic view of the cross section along the line A-A in FIG. 1.

The present invention will be further described in the following with reference to the drawings and the embodiments. As shown in FIGS. 1 and 2, the mining lamp with uniform auxiliary lights has a small volume and a light weight, it meets the IP67 safety standard in the overall sealing, and it is equipped with built-in rechargeable batteries and LED light sources, it comprises a housing, a main light source 8, auxiliary light sources 19, a main lamp cup 7, auxiliary lamp cups 18, a switch button 3, a battery 10, and an insert 14. A transparent lens 6 is provided in the front of the main light source 8 and lies tightly appressed to the lamp cup. The transparent lens is in the form of a flat plate, and it does not have any regulating or processing effect to the lights.

An auxiliary lamp cup 18 with an auxiliary light source 19 arranged on the center of its bottom is provided on both sides of the main lamp cup 7, wherein the main lamp cup 7 and the auxiliary lamp cups 18 are independent from one another and are structurally complete, and they are formed integrally with one another, so that the main lamp cup and the auxiliary lamp cups do not interfere one another in the quality of the projected lights. The auxiliary light sources and the main light source are arranged horizontally, in accordance with the observing and reading habits. Moreover, the horizontal arrangement is suitable for the shape and length of a general battery, and contributes to the decentralization of weight.

The side wall of the auxiliary lamp cup 18 is in the form of a rearward tapering horn enclosed by 4 to 10 flat reflecting surfaces arranged one after another, so that the lighting area has uniform illuminance and is free of spot-like shadow. There is not any curved surface in the reflecting surfaces. Even the curvature of transition at the joint between each two reflecting surfaces is as small as possible. Focusing will be caused as long as a curvature exists, which results in non-uniformity of the projection brightness. In the embodiment shown in the drawings, each auxiliary lamp cup is provided with six flat reflecting surfaces. If allowed in the space, a larger reflecting area can be obtained by using 8, 9 or 10 flat reflecting surfaces with unchanged depth and angle of inclination. However, too many reflecting surfaces require more advanced manufacturing technique, and may increase the possibility of focusing interference.

The angle between the reflecting surfaces and the optical axis affects the controllability of the lights of the light source. Small angles of the four surfaces to the optical axis allow a larger proportion of the lights emitted by the light sources to be reflected by the reflecting surfaces, so as to be controlled by projection. Limited by the projection distance, a small angle of inclination will result in loss of the area of the reflecting surfaces, and therefore in the loss of the illuminance. The depth of the lamp cup and the available area of the front end also limit the effective reflecting area. At the same time, the effective reflecting area also depends on the light emission angle, the height of the light source and the area of the bottom surface of the lamp cup. In the present embodiment, the height of the light source is less than 3 mm, and the area of the bottom surface of the lamp cup is reduced as much as possible. As shown in FIG. 1, the auxiliary lamp cup comprises an upper reflecting surface, a lower reflecting surface, a left reflecting surface and a right reflecting surface, wherein the angle between the upper reflecting surface and the optical axis of the auxiliary light source is 20° to 50°, the angle between the lower reflecting surface and the optical axis of the auxiliary light source is 35° to 60°, the distance between the front and the rear end faces of the auxiliary lamp cup is 6 to 15 mm. In the embodiment shown in FIGS. 1 to 4, the distance between the front and the rear end faces of the auxiliary lamp cup is 8 mm, the angle between the upper reflecting surface and the optical axis of the auxiliary light source is 25°, the angle between the lower reflecting surface and the optical axis of the auxiliary light source is 50°, and the angles of the optical axis of the auxiliary light source respectively to the left reflecting surface and to the right reflecting surface of the auxiliary lamp cup are between 13° and 20°. Such designs are based on comprehensive considerations of meeting the requirement of a controllable illumination in a small space. As a result, a common low-power LED light source is used to illuminate an area of about 1 square meter having uniform illuminance of not less than 15 lux on the lighting area lying 1 meter ahead of the mining lamp.

A pair of auxiliary light sources are provided, so that the lights projected by the pair of light sources are superimposed with one another, which helps to increase the illuminance, minimize the negative influences by the surface of the projection object, and improve the uniformity of the projected lights. The main lamp cup serves to condense lights in a long distance. The angle between its front end face and the optical axis of the main lamp cup is 65° to 69°, so that the optical axis is inclined downwards for an angle about 23° with respect to the horizontal line to be adaptive to the angle of inclination of nature sight of a man.

In order to ensure that the charge indicator does not affect the tightness of the mining lamp, the charge indicator is enclosed inside the housing, and a charge indicator hole 20 is arranged at the bottom of the main lamp cup which is integrally formed with the auxiliary lamp cups, a circuit board 9 is fixed on the back of the lamp cup and lies tightly appressed thereto, wherein the main light source 8, the auxiliary light sources 19 and the charge indicator arranged in the corresponding charge indicator hole are fixed on the circuit board. As a result, the installation process of the charge indicator is simplified, and it is convenient to observe and use the charge indicator.

The housing is formed of a bottom cover 2 and a cylindrical front cover 1 that are fixed as a whole in an air-tight manner by means of a sealing ring 12, the front cover is fixed with the transparent lens 6 at the front end of the mining lamp as a whole in an air-tight manner. In order to improve the wearing amenity and reduce the gravitational moment, the battery is transversely fixed at a location inside housing that is under the lamp cup and in close proximity to the bottom cover, and the switch button 3 is fixed to the housing in an air-tight manner and is arranged at a location on the top of the bottom cover 2 that is in close proximity to the rear end of the housing. In order to reduce the gravitational moment of the mining lamp as much as possible, the battery which has larger proportion by weight, and the switch button, are arranged as rearward as possible, so as to reduce the moment of the forward falling force. The switch button is arranged on the top and extends rearwards, by utilizing the space spared by the rearward curvature of the safety helmet, to reduce the thickness of the lamp body and the moment of the forward falling force as much as possible, without affecting the convenience of use.

DETAILED DESCRIPTION OF THE EMBODIMENTS

Preferable embodiments of the present invention will be described in further detail with reference to FIGS. 1-9.

Embodiment 1

As shown in FIG. 1, the mining lamp with uniform auxiliary lights comprises a housing, a main light source 8, two auxiliary light sources 19, a main lamp cup 7, and two auxiliary lamp cups 18. The main light cup 7 and the two auxiliary lamp cups 18 are arranged in the housing. The main light source 8 is accommodated in the main lamp cup 7, and the two auxiliary light sources 19 are respectively accommodated in the two auxiliary lamp cups 18. The two auxiliary light sources 19 are symmetrically located on the left and the right sides of the main light source 8 but not in the same line with the main light source 8.

The side wall of the auxiliary lamp cup 18 has a reflecting effect, and the reflecting surfaces are flat surfaces, and the side wall is in the form of a rearward tapering horn. It is preferable that the auxiliary lamp cup 18 is enclosed by a plurality of flat reflecting surfaces arranged one after another. It is further preferable that said plurality of flat reflecting surfaces are 4 to 10 flat reflecting surfaces. FIG. 1 shows the case in which there are 6 flat reflecting surfaces.

The auxiliary lamp cup is designed in the form of a rearward tapering horn enclosed by a plurality of flat reflecting surfaces, making it possible that after the lights given out from the auxiliary lamps are reflected by the reflecting surfaces, there will not be any interference between the adjacent reflected lights, and a focusing effect will not occur, so as to realize the effect that the area projected by the auxiliary lights has uniform illuminance and is free of spot-like shadow.

Figure 7:
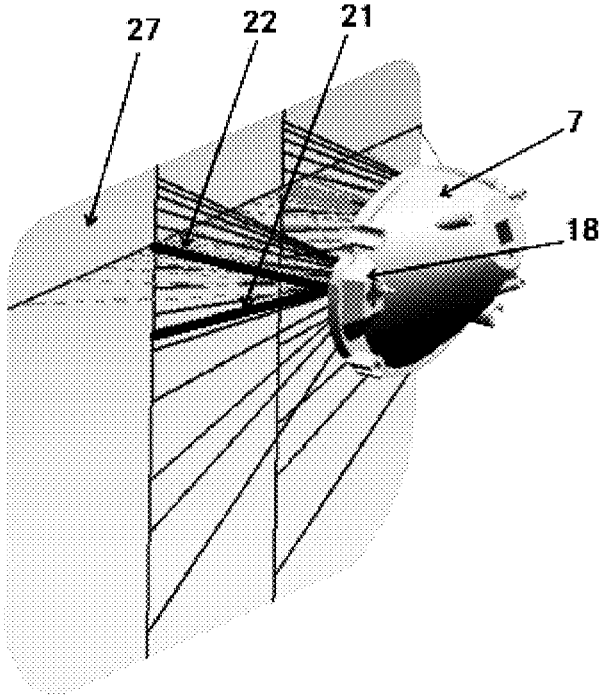
FIG. 7 is a schematic view of the lighting area with uniform auxiliary lights by the mining lamp according to the present invention.

Preferably, an auxiliary light source and an auxiliary lamp cup are provided on both the left and the right sides of the main lamp cup. The distance between the two auxiliary light sources on the two sides is approximately the distance between two eyes of a man, so that the lights directly irradiated by the two auxiliary light sources and the lights reflected by the reflecting surfaces of the auxiliary lamp cups form an area with superimposed lightening in the lighting area ahead, thereby providing a low-beam illumination effect with a higher and more uniform illuminance and without spot-like shadow. Please refer to FIGS. 6 and 7 for the schematic views of the irradiation. Under the effect of the direct lights of the auxiliary light sources 19 and the reflection of the auxiliary lamp cups 18, the lights projected by the auxiliary lamps on both sides are superimposed with one another, forming the area 27 illuminated with strong auxiliary lights as shown in FIG. 7, which further facilitates the observation of objects.

Taking a common low-power LED light source as an example, if it is designed in the same way as the auxiliary lamp cup in the present embodiment, it can project an area of about 1 square meter having uniform illuminance of not less than 15 lux on the lighting area lying 1 meter ahead of the mining lamp.

Embodiment 2

Figure 3:
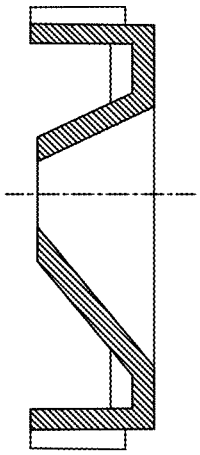
FIG. 3 is a schematic view of the cross section of the lamp cup in FIG. 1 along the line B-B.

As shown in FIG. 3, as a specific embodiment of the present invention, based on the wearable mining lamp described in the first embodiment, the angle between the front end face of the auxiliary lamp cup and the optical axis of the auxiliary light source is 87° to 91°, so that the auxiliary lamp irradiates with an approximately horizontal optical axis.

In such design, it is unnecessary to arrange the auxiliary lamp cup with inclination in the housing, which can reduce the space occupation inside the mining lamp to the uttermost, and facilitate the installation of the auxiliary lamp cup and other components, such as the circuit board and the front cover, of the mining lamp, as well as the connection there between.

Since the wearable mining lamp is usually worn on a safety helmet, the auxiliary lamp irradiates with an approximately horizontal optical axis, so that the light path of the auxiliary lights lies higher than the sight of the user and runs parallel thereto, as a result, the area illuminated with the auxiliary lights formed before the eyes of a user lies higher than the sight of the user, causing the asynchronization between the area illuminated with the auxiliary lights and the horizontal sight of the user. In order to solve this problem, it is preferable to design the angle between the upper reflecting surface of the auxiliary lamp cup and the optical axis of the auxiliary light source to be 20° to 50°, particularly 20° to 35°, more preferably 20° to 25°, for example, 25°.

An upper reflecting surface of the auxiliary lamp cup of such design can solve the problem that due to the irradiation of the auxiliary light sources with an approximately horizontal optical axis, the area illuminated with the auxiliary lights lies higher than the sight, so that the area illuminated with the auxiliary lights is asynchronous with the horizontal sight of the user. Please refer to FIG. 5 for the schematic view of the light path. Based on the basic principle that the angle of incidence is equal to the angle of reflection, the incident light group 25 emitted from the auxiliary light sources 19 is converted into a reflected light group 26 by means of the upper reflecting surface 23, and is projected in the peripheral field of the horizontal sight of human eyes about 1 meter ahead, i.e. the lights emitted by the auxiliary light source are reflected by the upper reflecting surface and then projected in the lower peripheral field of the area irradiated by the optical axis of the auxiliary lights. In this way, the problem that the lighting area of the auxiliary lights is relatively higher is solved, and the problem of the asynchronization between the area illuminated by the auxiliary lights and the horizontal sight of the user even in a limited space for assembling is solved.

On this basis, it is preferable to design the angle between the lower reflecting surface of the auxiliary lamp cup and the optical axis of the auxiliary light source to be 35° to 60°, preferably 50° to 60°, for example, 50°. As can be seen from FIG. 1, the area of the lower reflecting surface can be increased in such design. Based on the basic principle that the angle of incidence is equal to the angle of reflection, it can be seen from the light path shown in FIG. 5 the lights emitted from the auxiliary light source and the lights reflected by the upper reflecting surface are reflected by the lower reflecting surface and projected in a further lower peripheral field of the area irradiated by the optical axis of the auxiliary lights, so that the lighting area of the auxiliary lights is moved appropriately further downwards, and the brightness of the lighting area of the auxiliary lights is increased.

In the present embodiment, the distance between the front and the rear end faces of the auxiliary lamp cup is 6 to 15 mm, for example, 8 mm.

Embodiment 3

As shown in FIG. 2, as another embodiment of the present invention, the main lamp cup 7 of the wearable mining lamp described in the first or second embodiment is arranged in the housing with inclination, so that the angle between the optical axis of the main lamp cup and the front end face of the main lamp cup is 65° to 69°.

Figure 8A:
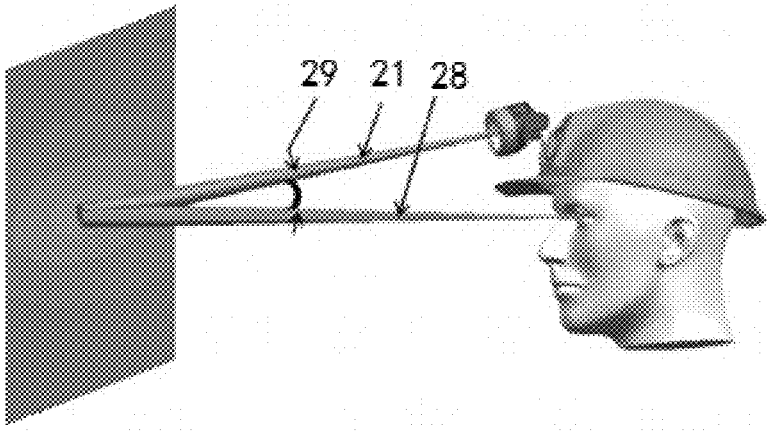
FIG. 8*a* is a schematic view of high illumination beam of a mining lamp in the prior art.

A wearable mining lamp is usually inserted and hung on a safety helmet and worn on the head. The main light source forms an optical axis of main light irradiation by the condensing effect of the lamp cup. If the main light also irradiates with a horizontal optical axis, the light path of the main light will also lie higher than the sight of the user and runs parallel thereto, as a result, the area illuminated with the main light formed before the eyes of a user lies higher than the sight of the user, causing the asynchronization between the area illuminated with the main light and the horizontal sight of the user. In order to make the illumination position of the optical axis of the main light synchronous with the horizontal sight of the user, it is required that the optical axis of main beam 21 forms a synchronous inclination angle 29 to the optical axis 28 of horizontal sight of a man, so as to guarantee a proper and effective illumination. In the existing mining lamps, the synchronization between the illumination position of the optical axis of the main light and the horizontal sight of the user is realized by adjusting the angle of the miming lamp hung and inserted on the safety helmet and keeping it to be the same value as the synchronous inclination angle 29, as shown in FIG. 8*a*. Such design will increase the feeling that the safety helmet is falling forwards when the wearable mining lamp is worn on it.

Figure 9A:
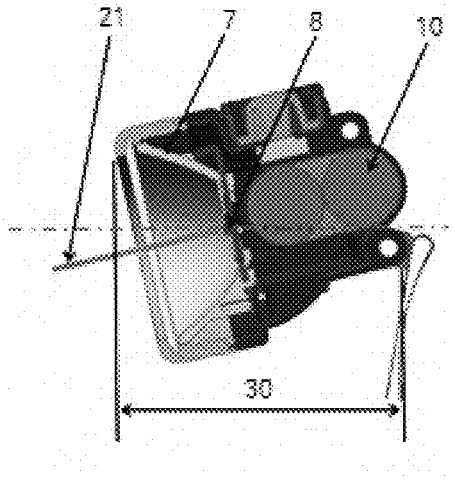
FIG. 9*a* is a sectional schematic view of a mining lamp in the prior art.

In addition, the lamp cup of existing mining lamps to reflect the main light is a revolutionary symmetric body shaped by the rotating of parabola around the optical axis. After the lamp cup is placed inside the mining lamp, the battery can only be arranged behind it, which results in a large thickness of the mining lamp. As shown in FIG. 9*a*, after the mining lamp is inserted and hung on a safety helmet, the center of gravity of the safety helmet will be displaced forwards and the user will have a sensible feeling that the safety helmet is falling forwards.

Figure 8B:
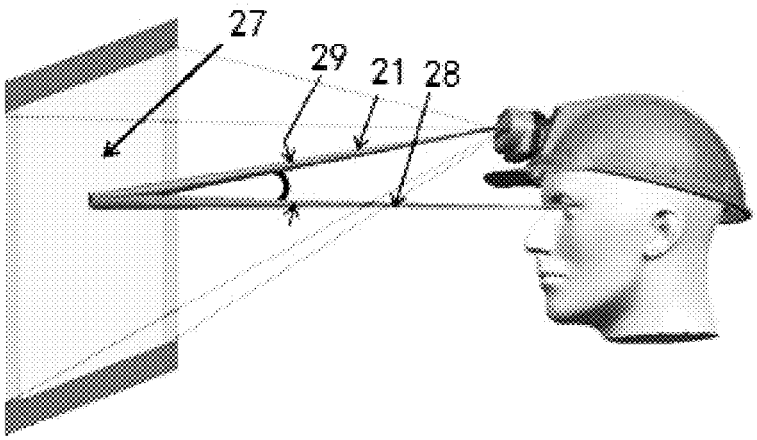
FIG. 8*b* is a schematic view of high illumination beam of the mining lamp according to the present invention.

As can be seen from FIG. 2, by using the design of the main lamp cup 7 according to the present invention, the front end face of the main lamp cup, which occupies most part of the internal space of the lamp, is beveled, so that the angle between the optical axis of the main lamp cup and the front end face of the main lamp cup is 65° to 69°. The main lamp cup is arranged inside the lamp with inclination, so that when it is worn on a safety helmet, as shown in FIG. 8*b*, the optical axis of main beam 21 forms a synchronous inclination angle 29 to the optical axis 28 of horizontal sight of a man. In this way, the problem of the asynchronization between the area illuminated by the main light and the horizontal sight of the user is solved, and a proper and effective illumination is guaranteed. At the same time, it is possible to achieve the technical effect that the area illuminated by the main light is synchronous with the area illuminated by the auxiliary lights and the horizontal sight of the user even in a limited space for assembling.

Figure 9B:
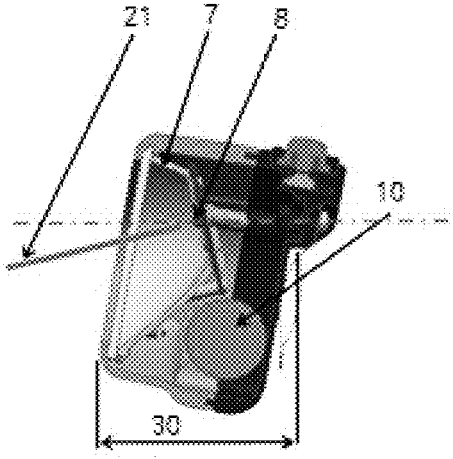
FIG. 9*b* is a sectional schematic view of the mining lamp according to the present invention.

In addition, the upwardly offset arrangement of the lamp cup in the housing not only reduces the thickness of the lamp cup, but also saves the space at the lower part so that the battery 10 can be positioned under the lamp cup, which further reduces the overall thickness 30 of the mining lamp, as shown in FIG. 9*b*. Compared to the design of the existing mining lamps, in which the battery is installed behind the circuit board of the main lamp cup, this embodiment has significantly reduced the gravitational moment produced by the mining lamp when it is worn on the safety helmet and released the feeling that the safety helmet is falling forwards, thereby improving the wearing amenity.

The wearable mining lamp according to the present embodiment solves the problem of providing a close-range illumination with high illuminance and without light spots and shadow interferences even in a very limited internal space of the wearable mining lamp, achieves the technical effect that the area illuminated by the main light is synchronous with the area illuminated by the auxiliary lights and the horizontal sight of the user, and realizes the technical effect of minimizing the thickness of the mining lamp and improving the wearing amenity.

Due to the small volume, the wearable mining lamp has a very small space for placing the auxiliary lamp cup after a main lamp cup has been arranged. The side wall of the auxiliary lamp cup is in the form of a rearward tapering horn enclosed by 4 to 10 flat reflecting surfaces arranged one after another, so that the adjacent reflected lights will not interfere one another or produce focusing effect. In addition, so that the lights directly irradiated by the auxiliary light sources on the two sides of the main lam cup and the lights reflected by the reflecting surfaces of the auxiliary lamp cups form an area with superimposed lightening in the lighting area ahead, thereby providing an illumination effect with high illuminance without light spots, which facilitates the observation of objects.

The angle between the front end face of the auxiliary lamp cup and the optical axis of the auxiliary light source is 87° to 91°, the angle between the upper reflecting surface of the auxiliary lamp cup and the optical axis of the auxiliary light source is 20° to 50°, the angle between the lower reflecting surface and the optical axis of the auxiliary light source is 35° to 60°, the distance between the front and the rear end faces of the auxiliary lamp cup is 6 to 15 mm, the angle between the front end face of the main lamp cup and the optical axis of the main lamp cup is 65° to 69°. Such design not only solves the technical problem that the area illuminated by the auxiliary lights is asynchronous with the area illuminated by the main light and the horizontal sight of the user when the space for assembling is limited, but also reduces the thickness of the main lamp cup, saves the space under the lamp cup for placing the battery, thereby significantly reducing the gravitational moment.

Embodiment 4

Figure 4:
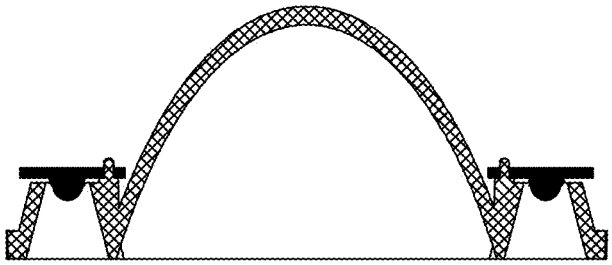
FIG. 4 is a schematic view of the cross section of the lamp cup in FIG. 1 along the line C-C.
Figure 5:
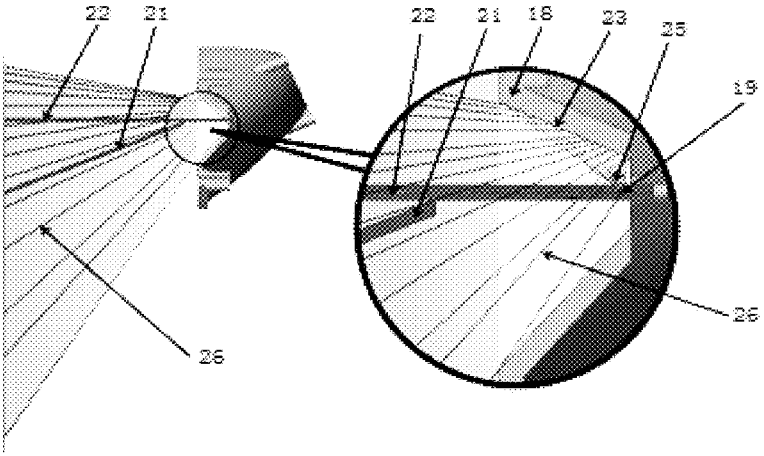
FIG. 5 is a schematic view of the vertical cross section of the lamp cup and illumination beam of the mining lamp according to the present invention.
Figure 6:
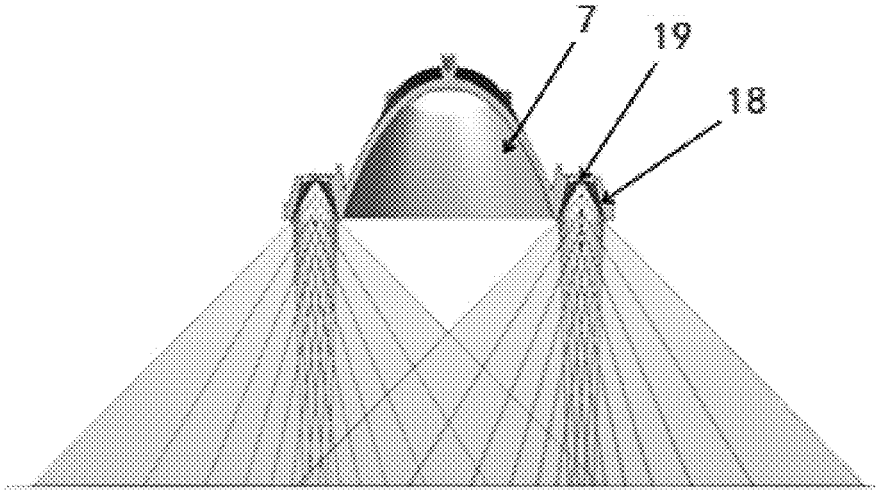
FIG. 6 is a schematic view of the transverse cross section of the lamp cup and illumination beam of the mining lamp according to the present invention.

As shown in FIGS. 1 and 4, as another embodiment of the present invention, the main lamp cup 7 and the auxiliary lamp cups 18 of the mining lamp according to the present invention as described in the aforementioned three embodiments can be formed integrally. When a fastening bolt is used to fix the circuit board of an auxiliary light source on the lamp cup, the entire lamp cup can be fixed on the front cover of the mining lamp at the same time. Such design reduces the number of fasteners, reduces the space occupation to the uttermost, keeps the relative position and angle between the auxiliary lamp cups and main lamp cup unchanged, and simplifies the installation process.

Furthermore, in order to ensure that the charge indicator does not affect the tightness of the mining lamp, the charge indicator is enclosed inside the housing, and a charge indicator hole 20 is arranged at the bottom of the main lamp cup which is integrally formed with the auxiliary lamp cups, a circuit board 9 is fixed on the back of the lamp cup and lies tightly appressed thereto, wherein the main light source 8, the auxiliary light sources 19 and the charge indicator arranged in the corresponding charge indicator hole are fixed on the circuit board. As a result, the installation process of the charge indicator is simplified, and it is convenient to observe and use the charge indicator.

As shown in FIG. 2, in order to improve the tightness of the mining lamp, it is preferable that the housing is formed of a bottom cover 2 and a cylindrical front cover 1 that are fixed as a whole in an air-tight manner by means of a sealing ring 12, and the front cover is fixed with the transparent lens 6 at the front end of the mining lamp as a whole in an air-tight manner.

The switch button 3 is fixed to the housing in an air-tight manner and is arranged at a location on the top of the bottom cover 2 that is in close proximity to the rear end of the housing. The switch button is arranged at the top and extends rearwards, by utilizing the space spared by the backward curvature of the safety helmet to further reduce the thickness of the lamp body and the moment of the forward falling force, without affecting the convenience of use.

The invention claimed is:

1. A wearable mining lamp, comprising:

a housing that houses a lamp assembly and a power source, wherein the housing comprises a bottom cover, a lens, a front cover having a front end and a rear end, the rear end being connected to the bottom cover and the front end being connected to the lens;

wherein the lamp assembly comprises:

a main lamp comprising a main light source residing in a main lamp cup; and two auxiliary lamps, one disposed on a right side of the main lamp while the other disposed on a left side of the main lamp, wherein each auxiliary lamp comprises an auxiliary light source residing in an auxiliary lamp cup, wherein the auxiliary lamp cup comprises 4 to 10 flat reflecting surfaces arranged into a shape of a rearward tapered horn, and wherein, when in use, an optical axis of the main lamp cup has an inclination further away from a horizontal direction than an inclination of an optical axis of the auxiliary light source from the horizontal direction in each of the two auxiliary lamps.

2. The mining lamp according to claim 1, wherein the main lamp cup is parabolic in shape and focuses light from the main light source into a main light beam.

3. The mining lamp according to claim 2, wherein, in each of the two auxiliary lamps, an angle between a front end surface of the auxiliary lamp cup and the optical axis of the auxiliary light source is 87° to 91°.

4. The mining lamp according to claim 3, wherein an angle between the optical axis of the auxiliary light source and a upper reflecting surface of the auxiliary lamp cup is 20° to 50°.

5. The mining lamp according to claim 4, wherein the angle between the optical axis of the auxiliary light source and the upper reflecting surface of the auxiliary lamp cup is 20° to 35°.

6. The mining lamp according to claim 5, wherein the angle between the optical axis of the auxiliary light source and the upper reflecting surface of the auxiliary lamp cup is 20° to 25°.

7. The mining lamp according to claim 4, wherein an angle between the optical axis of the auxiliary light source and a lower reflecting surface of the auxiliary lamp cup is 35° to 60°.

8. The mining lamp according to claim 7, wherein the angle between the optical axis of the auxiliary light source and the lower reflecting surface of the auxiliary lamp cup is 50° to 60°.

9. The mining lamp according to claim 7, wherein an angle between the optical axis of the auxiliary light source and a left reflecting surface of the auxiliary lamp cup, and an angle between the optical axis of the auxiliary light source and a right reflecting surface of the auxiliary lamp cup are both between 13° and 20°.

10. The mining lamp according to claim 9, wherein an angle between a front end face of the main lamp cup and the optical axis of the main lamp cup is 65° to 69°.

11. The mining lamp according to claim 10, wherein the main light source and the two auxiliary light sources are LED lights.

12. The mining lamp according to claim 2, wherein the auxiliary light source is located in an apex of the auxiliary lamp cup.

13. The mining lamp according to claim 1, wherein the auxiliary lamp cup has a length of 6 to 15 mm.

14. The mining lamp according to claim 13, wherein the length of the auxiliary lamp cup is 8 mm.

15. The mining lamp according to claim 1, wherein the main lamp further comprises a charge indicator hole disposed on the main lamp cup, a circuit board affixed to the lamp cup, wherein the main light source, the auxiliary light sources, and the charge indicator are connected to the circuit board.

16. The mining lamp according to claim 1, wherein the power source is one or more battery transversely fixed at a location inside the housing under the main lamp cup.

17. The mining lamp according to claim 1, further comprising a switch button arranged at a location on the bottom cover.

18. The mining lamp according to claim 1, wherein the two auxiliary lamps provides a uniform illumination on a lighting area lying 1 meter ahead of the mining lamp.

* * * * *